United States Patent [19]

Jay et al.

[11] 4,142,983

[45] Mar. 6, 1979

[54] PHTHALATE MIXTURES USEFUL AS LIQUID DIELECTRICS

[75] Inventors: Pierre Jay, Saint-Didier au Mont d'Or; Ghislain Schwachhofer, Miribel, both of France

[73] Assignee: Rhone-Poulenc Industries, Paris, France

[21] Appl. No.: 825,696

[22] Filed: Aug. 18, 1977

[30] Foreign Application Priority Data

Aug. 20, 1976 [FR] France ..... 76 258920

[51] Int. Cl.[2] ..... H01B 3/20

[52] U.S. Cl. ..... 252/64; 336/94; 361/315

[58] Field of Search ..... 252/64; 361/315, 319; 336/94; 174/17 LF

[56] References Cited

U.S. PATENT DOCUMENTS

| | | | |
|---|---|---|---|
| 1,931,455 | 10/1933 | Clark | 174/17 LF X |
| 3,740,625 | 6/1973 | Ross et al. | 252/64 X |
| 3,925,221 | 12/1975 | Eustance | 252/64 X |

*Primary Examiner*—Harris A. Pitlick
*Attorney, Agent, or Firm*—Bacon & Thomas

[57] ABSTRACT

Liquid dielectric compositions useful as electrical insulators are comprised of a mixture of a mixed phthalate of isobutyl alcohol and a branched higher alkanol of a diisobutyl phthalate and/or a phthalate of a branched higher alkanol, and wherein the alkyl groups of the constituents contain from 5 to 18 carbon atoms.

14 Claims, 5 Drawing Figures

Fig. 1.
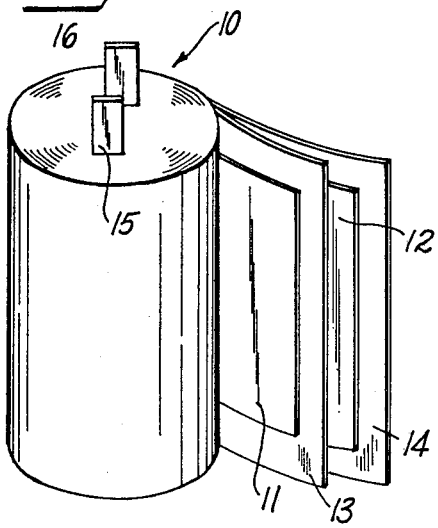
Fig. 2.
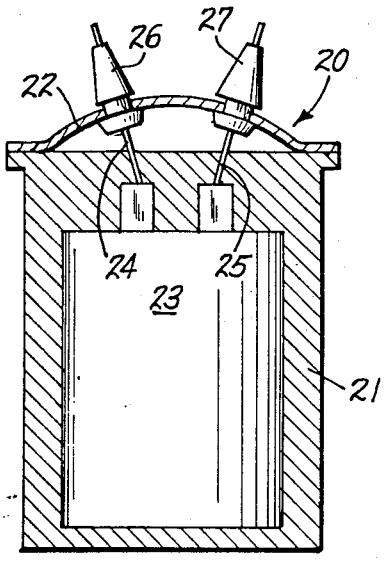
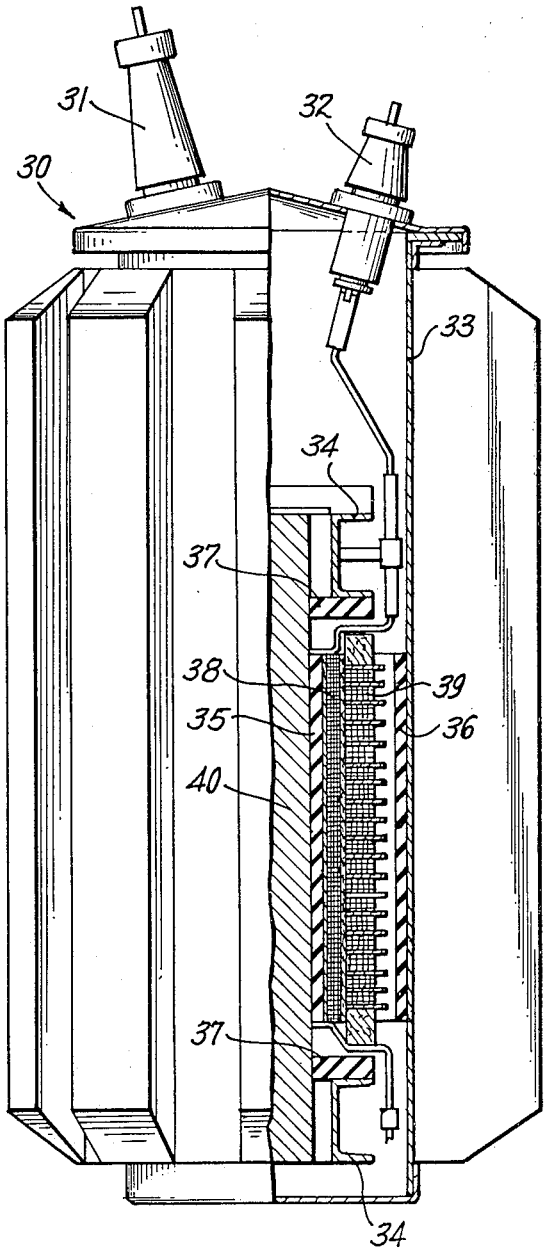
Fig. 3.

PHTHALATE MIXTURES USEFUL AS LIQUID DIELECTRICS

BACKGROUND OF THE INVENTION

1. Field of the Invention

The present invention relates to novel liquid dielectric compositions and, more especially, to liquid dielectrics comprising a mixture of a mixed phthalate of isobutyl alcohol and a branched higher alkanol of a diisobutyl phthalate and/or a phthalate of a branched higher alkanol.

2. Description of the Prior Art

The prior art recognizes various dielectric materials to be used, for example, as insulation for electrical equipment. It is appreciated that the liquids employed as these insulating materials in various electrical apparatus optimally combine certain properties such as, for example, a high permittivity of generally between about 4.8 and 6.0 at 90° C., a low coefficient of dissipation, good resistance to decomposition under the influence of diverse factors existing in service of the apparatus, a low viscosity at low temperatures, a low solidification point, and a low susceptibility to crystallization at the temperatures encountered during service. Moreover, while it is possible to balance these properties in a liquid dielectric composition when first formulated, obviously it is to be desired that these same properties maintain optimum values for the full duration of the life of the device or apparatus in which they are employed (e.g., condensers, transformers, etc.), regardless of the severity of use to which the devices are subjected and in spite of the length of service life projected therefor. Accordingly, it is manifest that the liquid dielectrics should exhibit substantial stability of the properties with time, which stability depends essentially on the stability of the chemical compositions utilized. Another complicating factor which materially effects a lack of stability in prior art liquid dielectric compositions regards the presence of various impurities, whether organic or inorganic in origin, which are inherent in the composition through, for example, formulation methodology, or as may be produced during the life of the device wherein the composition is utilized under service conditions including, most notably, temperature, pressure, and electrical voltage.

Various dielectric compositions and mixtures thereof have been proposed including, by way of example, mineral oils, aromatic chlorinated derivatives and certain esters of aliphatic or aromatic monoacids or polyacids. Typically, these compositions exhibit all of the requisite properties enumerated above, but to varying degrees which are rarely optimum and typically are balanced one against another to provide a serviceable dielectric.

Among these dielectric compositions found useful heretofore, it has been ascertained that the chlorinated polyphenyls (diphenyls and terphenyls), and in particular the chlorinated diphenyls, form a particularly valuable class of dielectric liquids in light of the ability of these compounds to combine many of the salient, and required, properties necessary for use as a dielectric liquid, while also possessed of suitable stability during service. Indeed, these compounds have been employed as liquid dielectrics essentially to the exclusion of all others for condenser applications. However, their use is not attended without disadvantages, particularly in light of their low biodegradability which fosters ecological problems. Accordingly, the art has recognized the need to develop products which are capable of adequately replacing this class of compounds.

Attention has been directed to the replacement of chlorinated polyphenyls by esters. This class of compositions again, however, presents serious disadvantages, particularly circumscribed by a pronounced lack of chemical stability under service conditions. Most particularly, the esters are sensitive to hydrolysis under the influence of even trace amounts of esterification catalysts, indigenous to the compositions unless one undertakes a difficult and expensive separatory process for the elimination of the same.

However, it has been found that the esters derived from alkanols, which are branched at the carbon in the $\alpha$-position relative to the carbon which bears the alcohol group, possess remarkable stability to hydrolysis and, thus, are particularly suitable for use as dielectric liquids. In this regard, see U.S. Pat. No. 3,740,625, and Rutkowski et al, Conference IEEE Power Engineering Society, Jan. 30, 1975, Doc. C 75, 241-5, at 7–12. Specifically, the phthalates of alcohols branched in the $\alpha$-position have been the subject of particular attention. Among the various compounds within this class may be mentioned diisobutyl phthalate, di-2-ethylhexyl phthalate, and diamyl phthalate. More particularly, diisobutyl phthalate and the mixed phthalates of isobutyl alcohol and higher alkanols branched in the $\alpha$-position are of considerable interest due to their high permittivity: diisobutyl phthalate exhibiting a permittivity of 5.5 at 90° C., and isobutyl-2-ethylhexyl phthalate a permittivity of 4.9 at 90° C.

Notwithstanding these high permittivity values, diisobutyl phthalate and the mixed phthalates of isobutyl alcohol and branched alkanols may not be used alone. In fact, it has been ascertained (and while not hitherto reported in the prior art) that pure diisobutyl phthalate has a melting point of −8° C., which results in crystallization of the composition at much too high a temperature to render the same useful within the context of the present invention. Other problems are evident with respect to the mixed isobutyl phthalates including a substantial difficulty in obtaining the same in a pure state due to the fact that during the reaction of phthalic acid or phthalic anhydride with isobutyl alcohol and the branched alkanol, diisobutyl phthalate and the phthalate of the branched alkanol are concomitantly formed, these latter components being very difficult and expensive to remove.

Consequently, it is essential to employ an ester mixture. However, it is known that ester mixtures can lead to inter-esterification reactions (alternately termed "redistribution reactions"), which result in the formation of a new mixture under the influences of temperature and impurities introduced by the esters themselves (esterification catalyst residues), or indeed formed from the metal parts (copper, tin, iron, and the like) of the device in which the dielectric is employed and with which the dielectric is in contact. This inter-esterification reaction can be represented, schematically, by:

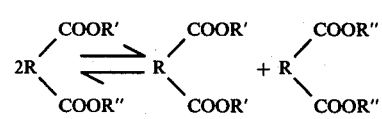

As regards the utility of such a composition as a liquid dielectric, the reaction, which evinces a change in the overall chemical composition, runs counter to the essential requirement of stability of the various properties necessary to yield a satisfactory insulating component. The compositional variation may take place rapidly, under the influence of an abrupt rise in temperature of the apparatus or device in which the dielectric is contained, or it may take place gradually. In either event, there is present the danger of variation in the overall characteristics of the apparatus or device in which the liquid dielectric is employed, therefore restricting the utility of such a mixture of phthalates.

Consequently, the need exists to provide an insulating composition, particularly a liquid dielectric, for use in electrical apparatus and devices, which composition exhibits substantial stability and meets all of the aforementioned criteria for satisfactory dielectric materials. The need further exists to provide such a liquid dielectric based upon mixtures of esters which meet the enumerated criteria.

SUMMARY OF THE INVENTION

In accordance with the noted deficiencies of prior art liquid dielectrics, it is an object of the present invention to provide an insulating composition based upon mixtures of esters, which composition presents little danger of change in properties under customary service conditions.

Consonant with the express objective of the present invention, it has now been determined in accordance therewith that a liquid dielectric composition, based upon mixtures of a mixed phthalate of isobutyl alcohol and a branched higher alkanol and of diisobutyl phthalate and/or a phthalate of a branched higher alkanol, is an extremely efficient dielectric composition which exhibits little tendency to undergo compositional variation through inter-esterification, under the usual service conditions of electrical apparatus and devices in which such liquid dielectrics are conventionally employed.

Yet further objects and advantages of the present invention will become apparent to the skilled artisan upon examination of the detailed description of the invention, taken in conjunction with the figures of drawing, wherein:

BRIEF DESCRIPTION OF THE DRAWINGS

FIG. 1 is a top perspective view of a capacitor which can be insulated according to the present invention;

FIG. 2 is a vertical cross-section of a capacitor which has been insulated according to the present invention;

FIG. 3 is a vertical cross-section, partly in elevation, of a transformer which has been insulated in accordance with the present invention;

DETAILED DESCRIPTION OF THE INVENTION

Figure 4:
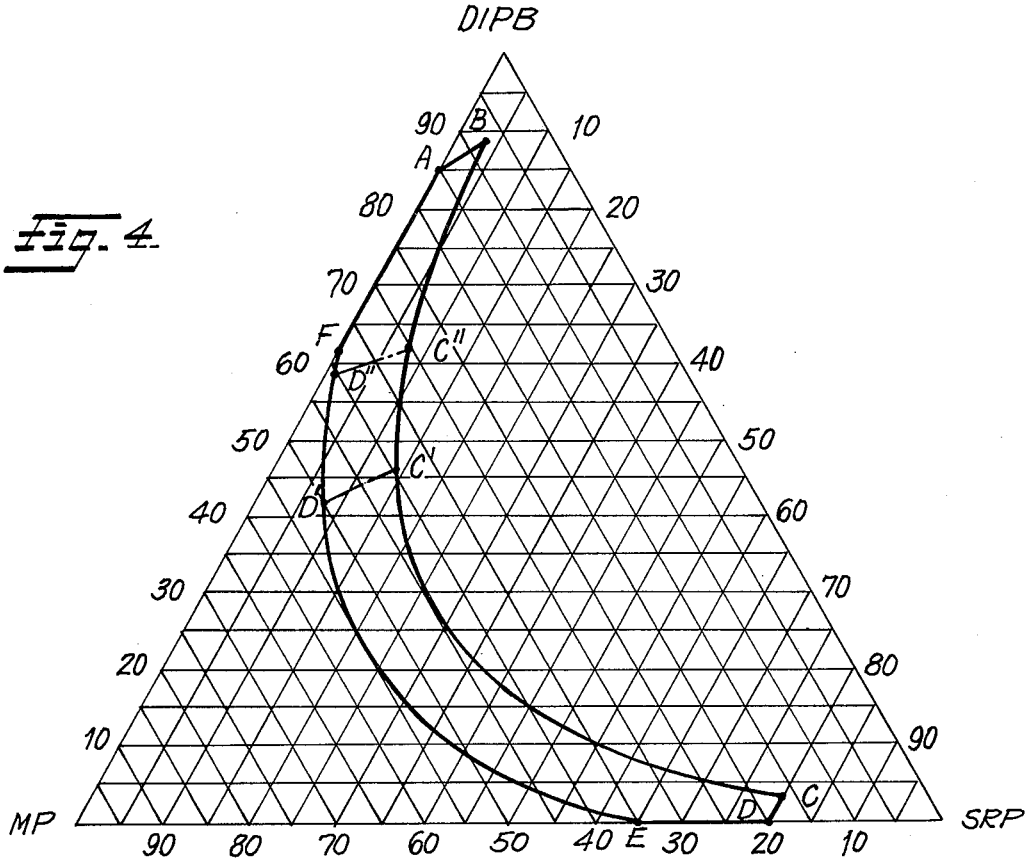
FIG. 4 is a ternary diagram illustrating preferred compositional embodiments of the liquid dielectric of the present invention, wherein DIBP represents diisobutyl phthalate, MP a mixed phthalate, and SRP a branched higher phthalate; and, FIG. 5 is a ternary diagram illustrating preferred embodiments of the liquid dielectric composition of the present invention, wherein DIBP represents diisobutyl phthalate, IBOP isobutyl-2-ethylhexyl phthalate, and DOP dioctyl phthalate.

In order to more fully elucidate upon the various objects and advantages of the present invention, the following detailed description will be given in terms of various preferred embodiments thereof, and exemplified with respect thereto. However, the skilled artisan will appreciate that the same are intended as illustrative, and in no wise limitative.

The present invention relates, generally, to liquid dielectric compositions comprising a mixture of a mixed phthalate of isobutyl alcohol and a branched higher alkanol and of diisobutyl phthalate and/or a phthalate of a branched higher alkanol. More specifically, the present invention relates to liquid dielectric compositions based on mixtures of mixed isobutyl and α-branched alkyl phthalates, the alkyl group containing from 5 to 18 carbon atoms, with isobutyl phthalate and/or di-(α-branched primary alkyl) phthalates in which the alkyl group also contains from 5 to 18 carbon atoms. The dielectric composition of the present invention is found to exhibit superior properties, as compared with prior art dielectric compositions, and specifically with regard to their substantial lack of a propensity to undergo compositional change through inter-esterification under normal service conditions of electrical apparatus and devices in which such liquid dielectric compositions are employed.

For the sake of convenience, the terms "higher branched alkanols" or "higher branched alkyl" will be employed in the present specification and claims to connote primary alkanols, or primary alkyl groups, respectively, which are branched in the α-position and contain from 5 to 18 carbon atoms.

In a particularly preferred embodiment, the liquid dielectric composition is predicated upon mixtures of mixed isobutyl and α-branched higher primary alkyl phthalates, of the general formula:

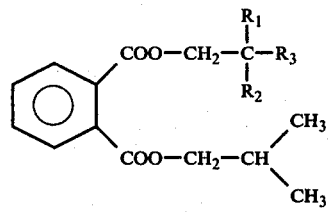

(I)

with diisobutyl phthalate and/or a di-(α-branched primary alkyl) phthalate of the general formula:

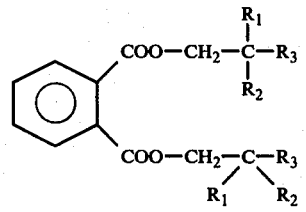

(II)

The liquid dielectric composition formulated from the foregoing mixture exhibits a permittivity of from about 4.5 to about 5.5 at 90° C., and also is imbued with a high stability against interesterification. Preferably, the dielectric composition comprises from about 8 to about 55%, by weight, of a mixed phthalate in accordance with formula (I), from about 0 to about 89%, by weight, of diisobutyl phthalate, and from about 0 to about 80%, by weight, of a branched dialkyl phthalate in accordance with formula (II); provided, however, that the composition resultant from the mixtures is such that it corresponds to one falling within the geometrically confines of points A, B, C, D, E, F, A, of the ternary diagram represented in FIG. 4.

In the aforementioned formulae (I) and (II), $R_1$ represents an alkyl radical having from 1 to 2 carbon atoms, $R_2$ a linear or branched alkyl radical having from 2 to 12 carbon atoms, and $R_3$ a hydrogen atom or an alkyl radical the same as $R_1$. Preferably, $R_1$ represents a methyl or ethyl radical, $R_2$ represnets an ethyl, n-propyl, isopropyl, n-butyl, sec-butyl, t-butyl, n-pentyl, 2-methyl-n-butyl, 3-methyl-butyl, n-hexyl, n-heptyl, n-octyl, 3-ethyl-n-hexyl, decyl, undecyl, or dodecyl radical, and $R_3$ represents a methyl or ethyl radical.

Exemplary of those branched alcohols which have from 5 to 18 carbon atoms and which are particularly suitable for use in preparation of the mixed esters of formula (I), or the esters of formula (II), are 2-methylbutanol, 2,2-dimethyl-pentanol, 2-ethyl-pentanol, 2,2-diethyl-pentanol, 2,2-dimethyl-hexanol, 2-ethyl-hexanol, 2-methyl-heptanol, 2,2-dimethyl-heptanol, 2-ethyl-heptanol, 2,2-dimethyl-octanol, 2,2,4-trimethyl-pentanol, and 2-ethyl-butanol. Among these exemplary branched alcohols, the 2-ethyl-hexanol is most preferred for the preparation of the mixed esters and the phthalates of formula (II) in order to obtain the dielectric mixtures in accordance with the present invention.

Exemplary of dielectric mixtures which have been found stable against the inter-esterification reaction, which is noted to be highly deleterious to optimum utility of liquid dielectrics, there are included diisobutyl phthalate/mixed isobutyl 2-ethylhexyl phthalate; diisobutyl phthalate/mixed isobutyl 2-ethylhexyl phthalate/-di-2-ethylhexyl phthalate; diisobutyl phthalate (DIBP)-/mixed isobutyl 2-methylbutyl phthalate; mixed isobutyl 2,2-dimethylbutyl phthalate/DIBP and/or bis-(2,2-dimethylbutyl) phthalate; mixed isobutyl 2-ethylpentyl phthalate/DIBP and/or di-2-ethylpentyl phthalate; mixed isobutyl 2,2-diethylhexyl phthalate/DIBP and-/or bis-(2,2-diethylhexyl) phthalate. However, it is equally well conceivable, without extending beyond the scope of the present invention, to employ a phthalate of a branched alkanol containing from 5 to 18 carbon atoms, wherein the alkyl radical is different from that of the mixed phthalate. It is not found that this deviation provides any particular advantages, however.

The propensity of the dielectric compositions of the mixtures of mixed phthalates of isobutyl alcohol and branched alkanols with from 5 to 18 carbon atoms, with DIBP and/or phthalates of higher branched alkanols, to undergo compositional variation may be determined by means of a simple test. This test consists of heating the mixture of phthalates at 150° C. for 2.5 hours in the presence of 0.5%, by weight, butyl titanate which is particularly chosen because it is an excellent esterification catalyst. Stability of the composition is measured by determining the absolute value of the variation in the percentage, by weight, of each of the constituents of the mixture under these test conditions, and calculating the sum of the absolute values. Preferably, no change in composition will occur under these conditions, and this represents a particularly preferred liquid dielectric in accordance with the present invention; albeit, changes in composition represented by the sum of the absolute values, of the variations of each of the constituents of the mixture of less than 15, and preferably less than 12, are likewise envisioned within the scope of the present invention.

The liquid dielectric compositions according to the present invention may be formulated by mixing suitable amounts of the various constituents; but, as a practical matter, it is preferable to begin with the esterification reaction mixtures from which, if necessary, the catalyst residues and unconverted starting alcohols and acids have been removed. These mixtures are brought to the desired compositions by partial or complete removal of one or more of the constituents by any suitable means, preferably by distillation and/or by addition of a sufficient amount of one or more of the appropriate constituents in the pure state.

Among the mixtures useful in terms of the present invention, it is preferable to employ those with composition, by weight, corresponding to any of the points falling within the geometric area delimited by A, B, C', D', F, A on the ternary diagram of FIG. 4. More preferable are those compositions corresponding to any of the points falling within the geometric area delimited A, B, C'', D'', F, A. Among these compositions the most suitable have been found to be those based on the mixed isobutyl 2-ethylhexyl phthalate and diisobutyl phthalate and/or di-2-ethylhexyl phthalate (commonly referred to as dioctyl phthalate or DOP). The most preferred compositions employ from about 8 to about 50%, by weight, of mixed phthalates of formula (I), and more particularly from about 8 to about 41%, by weight; from about 42 to about 89%, by weight, of diisobutyl phthalate, and more particularly from 57 to 89%, by weight; and from about 0 to about 13%, by weight, of a higher branched phthalate of formula (II), and more particularly from about 0 to about 7%, by weight.

Figure 5:
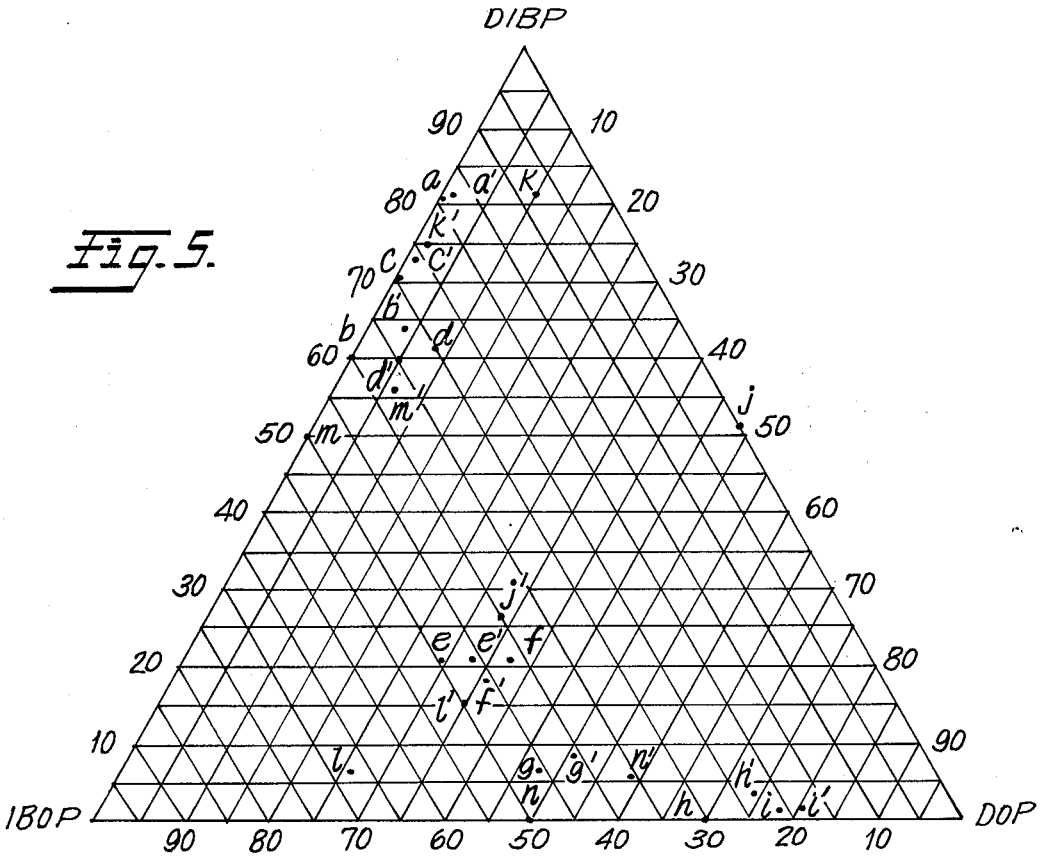

FIG. 5 represents the ternary diagram of mixtures based upon mixed isobutyl 2-ethylhexyl phthalate (IBOP), diisobutyl phthalate (DIBP), and dioctyl phthalate (DOP). The points *a, b, c, d, e, f, g, h,* and *i* correspond to compositions in accordance with the present invention, while the points *j, k, l, m,* and *n* correspond to compositions not defined by the area A, B, C, D, E, F, A of FIG. 4, and thus fall beyond the scope of the present invention. For each of these points, the composition of the mixture obtained after conducting the inter-esterification test described hereinabove has been determined, and the points corresponding to the resultant mixtures have been plotted on FIG. 5, and are identified as *a', b', c', d', e', f', g', h', i', j', k', l', m'* and *n'*.

Referring specifically to the figures of drawing, FIG. 1 depicts a component 10 of a capacitor, comprising two electrodes which are defined by the foils 11 and 12, which foils are made of aluminum or any other suitable material and which are shown as being separated by the two layers of insulation 13 and 14. These insulating layers 13 and 14 can either be paper foil, or, alternatively, same can be films of the various plastics or the various composites known and similarly used in the art, for example, a pair of polyolefin foils with a layer of paper sandwiched therebetween. The elements 15 and 16 define strips utilized for establishing electrical contact.

FIG. 2 of the drawing, a vertical cross-section of a capacitor 20, includes a metallic housing 21 with a cover 22 therefor insuring a tight fit, a capacitor component 23 of the type illustrated in the FIG. 1, and connectors 24 and 25 joining the bobbin plates to the outer bushings 26 and 27. The condenser tank is filled with the dielectric composition of the present invention such that the liquid fully impregnates all dielectric material and concomitantly fills all voids and interstices within the apparatus.

In FIG. 3 there is illustrated a transformer 30 including a high voltage bushing 31, and low voltage bushing 32, a transformer casing 33, pressure flanges 34 and insulating barriers 35 and 36 which, on the one hand, respectively separate the low voltage coil 38 from the iron core 40, and on the other separate the high voltage coil 39 from the casing. The strips 37 are insulating spacers, and the conductors of the low voltage and high voltage coils are suitably insulated with any solid dielectric material, such as paper. The transformer casing of FIG. 3 is filled with the composition of the present invention. This dielectric liquid fills all of the interspaces in the transformer and also fully impregnates both the coils and the various other elements of the apparatus.

It will also be appreciated that the dielectric liquids of the invention are useful as insulators for all types of electrical equipment, in general.

It is feasible to incorporate into the dielectric compositions of the present invention various adjuvants typically employed, and especially acid acceptors such as epoxy compounds. Among these there may be cataloged, without limitation, the diglycidyl ether of bisphenol A, styrene oxide, 1,3-bis-(2,3-epoxy-propoxy)-benzene, and di-2-ethylhexyl 4,5-epoxy-tetrahydrophthalate. Typically, these adjuvants will be employed at from about 0.1 to about 5%, by weight, relative to the mixture of phthalates.

In order to yet further illustrate the present invention, the following exemplary data will be presented.

EXAMPLES 100 g mixtures of phthalates having the compositions indicated in the following Table, and 1 g of t-butyl titanate are introduced into a 250 $cm^3$ glass flask equipped with a reflux condenser, a thermometer, a central mechanical stirring device, and a heating element. The contents are heated to 150° C., under stirring, and are maintained at this temperature for 2.5 hours. The reaction mixture is allowed to cool to 20° C. and the phthalates are analyzed by vapor phase chromatography. The Table records the resultant data.

The data of the Table set forth Examples 1–9, which correspond with compositions in accordance with the present invention, and comparative Examples 10–14, which fall beyond the scope of the present invention. The compositional points corresponding to each of the examples are plotted on the ternary diagram of FIG. 5 for purposes of comparison.

Reviewing the data of the Table, it is immediately apparent that the compositions of the present invention are substantially more stable than those of the comparative examples corresponding to compositions beyond the scope of the present invention. That is, the propensity for inter-esterification is markedly less for the compositions of the present invention, without sacrifice of the qualities necessary for good dielectric compositions.

While the invention has now been described in terms of certain preferred embodiments, and exemplified with respect thereto, the skilled artisan will appreciate that various modifications, substitutions, changes, and omissions may be made without departing from the spirit thereof. Accordingly, it is intended that the scope of the present invention be limited solely by that of the following claims.

What is claimed is:

1. A liquid dielectric composition comprising a mixture of:

(a) mixed isobutyl and α-branched higher primary alkyl phthalates of the general formula:

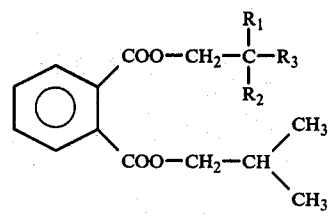

(I)

with, (b) a compound selected from the group consisting of diisobutyl phthalate, di(α-branched higher primary alkyl) phthalate of the general formula:

TABLE

| Examples | Pairs of points of Figure 5 | DIBP, % by weight INITIAL | FINAL | ΔP (1) | IBOP INITIAL | FINAL | ΔP (1) | DOP INITIAL | FINAL | ΔP (1) | ΣΔP (2) |
|---|---|---|---|---|---|---|---|---|---|---|---|
| 1 | (a,a') | 80.33 | 81.02 | 0.69 | 19.39 | 17.93 | 1.46 | 0.28 | 1.05 | 0.77 | 2.92 |
| 2 | (b,b') | 60.35 | 63.82 | 3.47 | 39.27 | 32.33 | 6.94 | 0.38 | 3.85 | 3.47 | 13.88 |
| 3 | (c,c') | 70.32 | 71.49 | 1.17 | 29.15 | 27.59 | 1.56 | 0.33 | 0.92 | 0.59 | 3.32 |
| 4 | (d,d') | 60.87 | 59.37 | 1.5 | 31.15 | 35.27 | 4.12 | 7.98 | 5.36 | 2.62 | 8.24 |
| 5 | (e,e') | 20.77 | 22.34 | 1.57 | 54.70 | 50.93 | 3.77 | 24.53 | 26.73 | 2.20 | 7.54 |
| 6 | (f,f') | 20.64 | 18.21 | 2.43 | 43.79 | 49.30 | 5.81 | 35.57 | 32.49 | 3.08 | 11.02 |
| 7 | (g,g') | 6.97 | 8.51 | 1.54 | 45.64 | 41.15 | 4.49 | 47.39 | 50.56 | 3.17 | 9.20 |
| 8 | (h,h') | 0 | 2.20 | 2.20 | 30.06 | 25.25 | 4.81 | 69.94 | 72.55 | 2.61 | 9.62 |
| 9 | (i,i') | 0.2 | 1.08 | 0.88 | 20.42 | 18.22 | 2.20 | 79.38 | 80.70 | 1.32 | 4.40 |
| Comparative Experiments | | | | | | | | | | | |
| 10 | (j,j') | 50.54 | 26.26 | 24.28 | 0 | 41.74 | 41.74 | 49.46 | 32 | 17.46 | 82.94 |
| 11 | (k,k') | 81.16 | 74.68 | 6.48 | 8.58 | 23.32 | 14.74 | 10.26 | 2 | 8.26 | 40.58 |
| 12 | (l,l') | 6.33 | 16.10 | 9.77 | 73.1 | 50.20 | 22.9 | 20.57 | 33.70 | 13.13 | 45.80 |
| 13 | (m,m') | 50 | 55.95 | 5.95 | 50 | 37.69 | 12.31 | 0 | 6.36 | 6.36 | 24.62 |
| 14 | (n,n') | 0 | 5.64 | 5.64 | 50 | 36.94 | 13.06 | 50 | 57.42 | 7.42 | 26.12 |

(1) ΔP: absolute value of the variation in the content by weight of the constituent considered.
(2) ΣΔP: sum of the absolute values of the variation of the content by weight of the constituents.

(II)

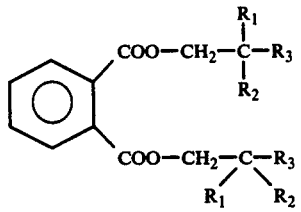

wherein $R_1$ is an alkyl radical having from 1 to 2 carbon atoms, $R_2$ is a linear or branched alkyl radical having from 2 to 12 carbon atoms, and $R_3$ is a hydrogen atom or an alkyl radical as defined by $R_1$, and mixtures thereof, said composition being within that geometrical area bounded by the points A, B, C, D, E, F, A on the ternary diagram of FIG. 4.

2. The liquid dielectric composition of claim 1, comprising from about 8 to about 55% of said mixed phthalate (I); from about 0 to about 89% of said diisobutyl phthalate and from about 0 to about 80% of said di(-higher branched alkyl) phthalate (II).

3. The liquid dielectric composition of claim 2, wherein said mixed phthalate is isobutyl 2-ethyl hexyl phthalate, and said higher alkyl phthalate is di-2-ethyl hexyl phthalate.

4. The liquid dielectric composition of claim 2, wherein said mixed phthalate (I) is present in the range of from about 8 to about 41%, said diisobutyl phthalate is present in the range of about 57 to about 89%, and said phthalate (II) is present in the range of from about 0 to about 7%.

5. The liquid dielectric composition of claim 2, further comprising from about 0.01 to about 5% of an acid acceptor.

6. The liquid dielectric composition of claim 5, wherein said acid acceptor is an epoxy compound.

7. The liquid dielectric composition of claim 1, said composition being within that geometrical area bounded by the points A, B, C', D', F, A on the ternary diagram of FIG. 4.

8. The liquid dielectric composition of claim 1, said composition being within that geometrical area bounded by the points A, B, C'', D'', F, A on the ternary diagram of FIG. 4.

9. The liquid dielectric composition of claim 1, wherein $R_2$ is selected from the group consisting of ethyl, n-propyl, isopropyl, n-butyl, sec-butyl, t-butyl, n-pentyl, 2-methyl-n-butyl, 3-methyl-butyl, n-hexyl, n-heptyl, n-octyl, 3-ethyl-n-hexyl, decyl, undecyl and dodecyl.

10. The liquid dielectric composition of claim 1, said composition exhibiting a permittivity of from about 4.5 to about 5.5 at 90° C.

11. The liquid dielectric composition of claim 1, selected from the group consisting of diisobutyl phthalate/mixed isobutyl-2-ethylhexyl phthalate; diisobutyl phthalate/mixed isobutyl-2-ethylhexyl phthalate/di-2-ethylhexyl phthalate; diisobutyl phthalate (DIBP)/mixed isobutyl-2-methylbutyl phthalate; mixed isobutyl-2,2-dimethylbutyl phthalate/DIBP and/or bis-(2,2-dimethylbutyl) phthalate; mixed isobutyl-2-ethylpentyl phthalate/DIBP and/or di-2-ethylpentyl phthalate; and mixed isobutyl-2,2-diethylhexyl phthalate/DIBP and/or bis-(2,2-diethylhexyl) phthalate.

12. In an insulated electrical component, the improvement which comprises insulation material including the dielectric composition as defined by claim 1.

13. The insulated electrical component as defined by claim 12, comprising an insulated condenser.

14. The insulated electrical component as defined by claim 12, comprising an insulated transformer.

* * * * *